United States Patent [19]

Pohl

[11] 4,425,019

[45] Jan. 10, 1984

[54] MULTIPLE ELECTRICAL CONNECTOR BLOCK WITH WIRE WRAP PINS

[75] Inventor: Karl-Heinz Pohl, Woodbury, Conn.

[73] Assignee: The Siemon Company, Watertown, Conn.

[21] Appl. No.: 271,431

[22] Filed: Jun. 8, 1981

[51] Int. Cl.[3] ..... H01R 9/24

[52] U.S. Cl. ..... 339/198 R; 339/97 R

[58] Field of Search ..... 339/206 R, 206 P, 196, 339/198, 96, 98, 97 R, 99 R

[56] References Cited

U.S. PATENT DOCUMENTS 3,132,913 5/1964 Pohl ..... 339/97 P

*Primary Examiner*—Eugene F. Desmond
*Assistant Examiner*—David Pirlot
*Attorney, Agent, or Firm*—David S. Fishman

[57] ABSTRACT

A connector block including wire-formed multiple solderless connectors. The block has retainer and body sections with slots and bridge elements to house and define rows and columns of the connectors. The block is further provided with wire wrap pins which project from one side of the block and which are in mechanical and electrical contact with the wire formed solderless connectors.

38 Claims, 5 Drawing Figures

MULTIPLE ELECTRICAL CONNECTOR BLOCK WITH WIRE WRAP PINS

BACKGROUND OF THE INVENTION (1) Field of the Invention

The present invention relates to the field of multiple electrical connectors and mounting blocks therefor. Specifically, the present invention is directed to a new and improved mounting block for wire formed solderless multiple connectors.

(2) Description of the Prior Art

Solderless multiple connectors have found applicability in many fields, particularly in the field of telephonic equipment. These connectors may be used to establish interconnections between small diameter, insulated conductors in confined spaces where the use of screw type terminal strips or similar connecting devices are not suitable. In addition, some of these prior art connectors strip away the insulation from conductors inserted therein.

One type of prior art solderless connector, disclosed in U.S. Pat. No. 3,112,147, is sometimes referred to in the art as a "66 Type" connector. These "66 Type" connectors generally have a clip type appearance wherein the conductors are forced between two legs. A further feature of this type of prior art connector is that it is provided with a tail or wire wrap pin, to which a communications system conductor may be secured. This allowed flexibility in designing interconnection arrangements. A disadvantage with these prior art connectors is that they are comparatively large in size.

Another type of prior art multiple connector is disclosed in my U.S. Pat. No. 3,132,913. In this patent the multiple connector is formed from a continuous filament of electrically conductive wire which is bent to form alternating loops. The loops are positioned so that their sides contact the sides of the adjacent loop. Electrical conductors are then forced between these sides. A serious disadvantage of the connectors disclosed in U.S. Pat. No. 3,132,913 is the lack of tails or wire wrap pins. This severely reduces the possible number of interconnecting arrangements.

SUMMARY OF THE PRESENT INVENTION

The present invention overcomes the above discussed disadvantages and other deficiencies of the prior art by providing a connector assembly utilizing wire formed multiple connector elements and including wire-wrap pins.

In accordance with the present invention a multiple terminal solderless electrical connector is formed from a length of wire. The wire is alternately looped to form two oppositely facing rows of loops. A first row of loops is formed with relatively straight parallel sides, while the second row of loops, which interconnect the loops of the first row, is formed with inwardly converging sides. The loops of the first row are configured so that the straight side portions of adjacent loops are in intimate contact to form an individual connector. The loops in the second row are spatially separated from each other.

The mounting block is provided with slots for receiving the wire connectors. The dimensions of the slots are such so that the wire connectors are prevented from lateral movement and constrained from any type of displacement. The connectors are positioned within the mounting blocks so that the first row of loops is exposed for receiving wire conductors. The mounting block is further provided with a plate for retaining the connectors within the blocks. This plate supports a plurality of wire wrap pins that are positioned to be engaged between the spatially separated loops of the second row. The gap between the loops is such so that a firm engagement with the wire wrap pins is effected. The pins extend outwardly from the plate and thus from the connector assembly.

DESCRIPTION OF THE DRAWING

The present invention may be better understood and its numerous objects and advantages will become apparent to those skilled in the art by reference to the accompanying drawing wherein like reference numerals refer to like elements in the several FIGURES and wherein.

DESCRIPTION OF THE PREFERRED EMBODIMENTS

Figure 2:
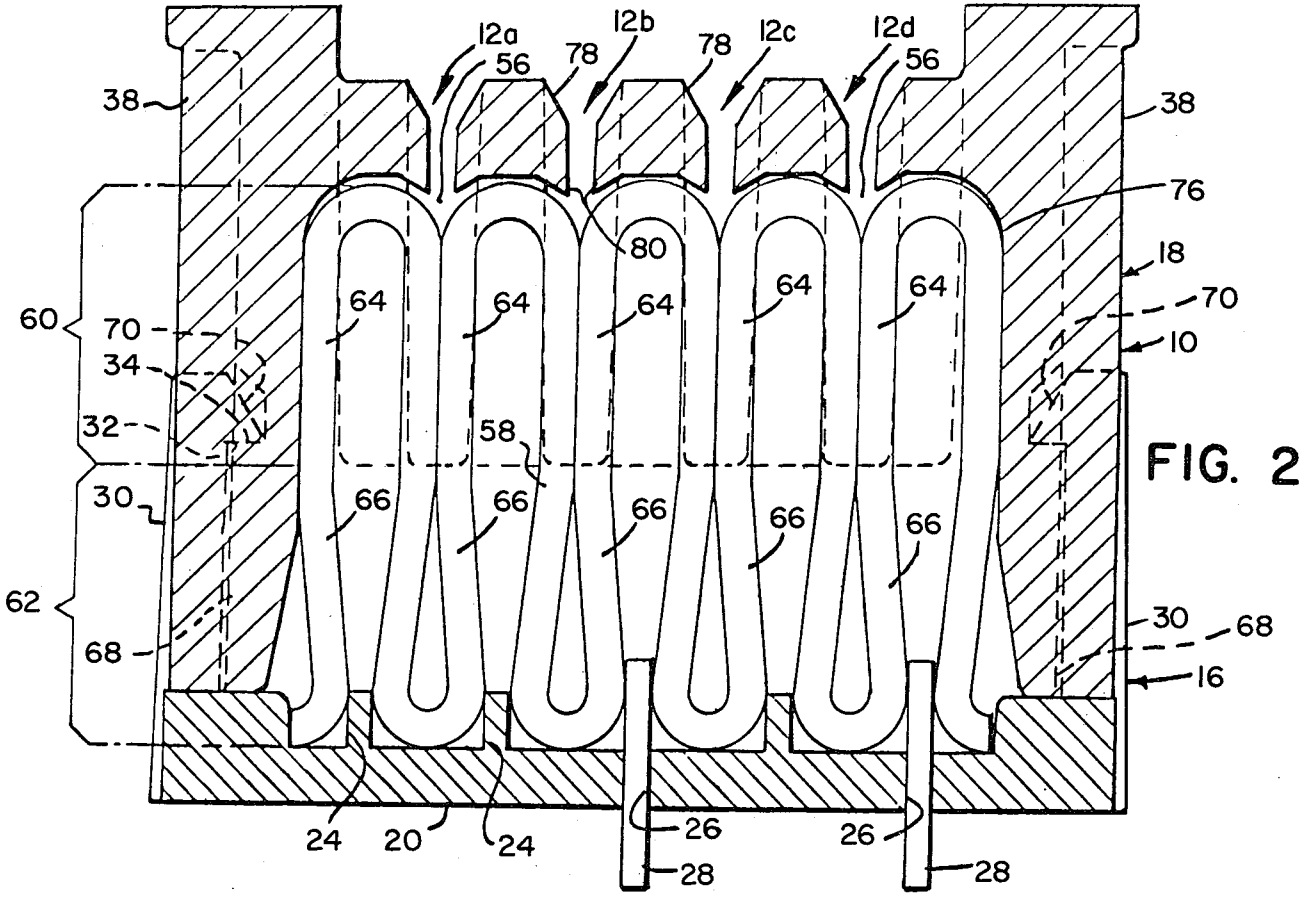
FIG. 2 is a cross-sectional side elevation view of the connector block of FIGS. 1(A) and 1(B) in assembled form and with an electrical connector element installed.
Figure 3:
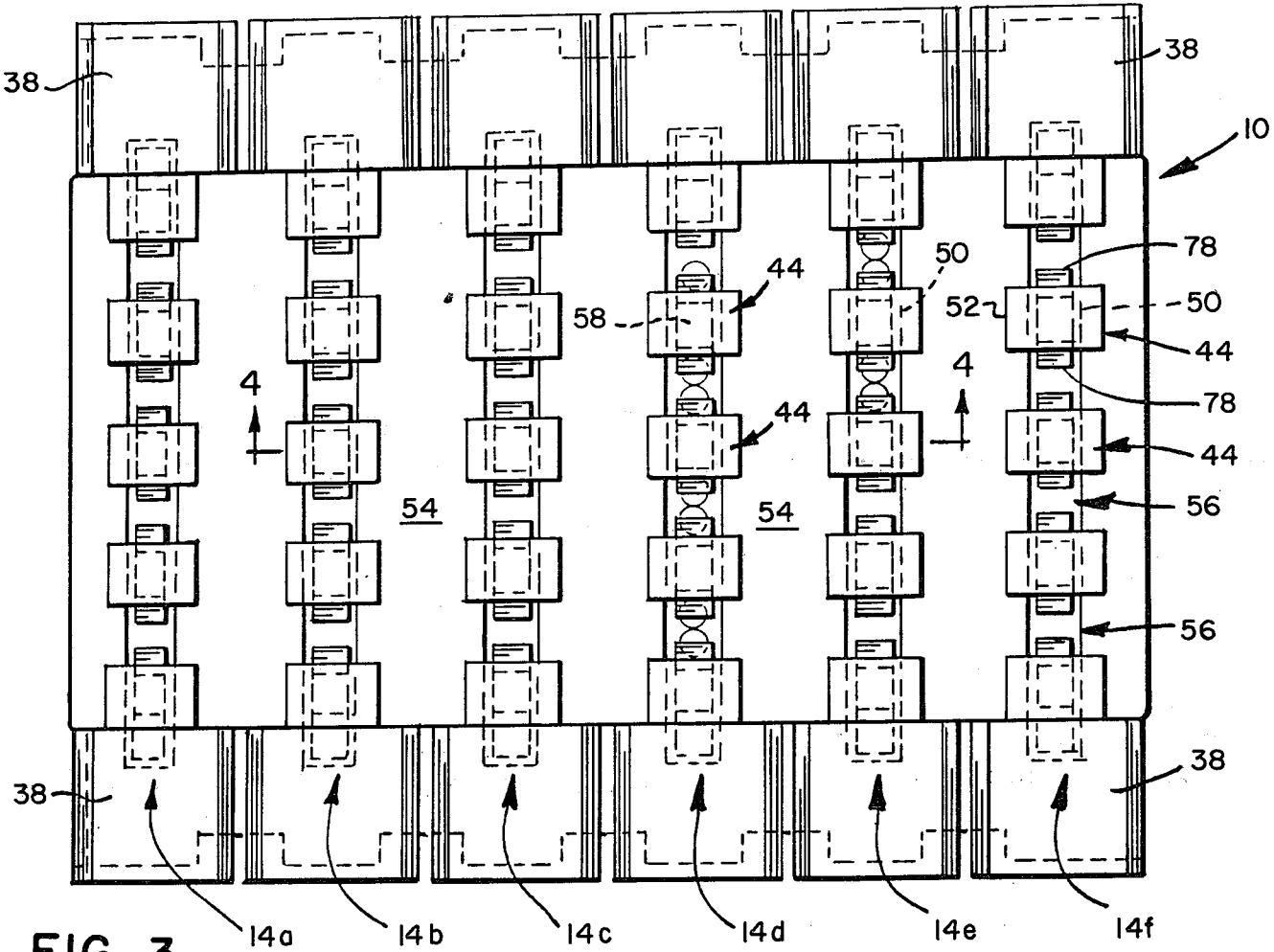
FIG. 3 is a top plan view of the connector block of FIG. 1.

FIGS. 2 and 3 show a block, generally indicated at 10, for 24 connector locations, arranged in a four by six array. That is, front to back of the block there are four columns of connector locations, each of which has six rows from side to side. While the details which make up these four columns and six rows will be discussed in more detail hereinafter, the four columns are generally indicated at 12(*a*) through 12(*d*) in FIG. 2, and the six rows are generally indicated at 14(*a*) through 14(*f*) in FIG. 3. Of course, it will be understood that any desired number of rows and columns can be used, and the four by six array is merely for purposes of illustration.

Figure 1A:
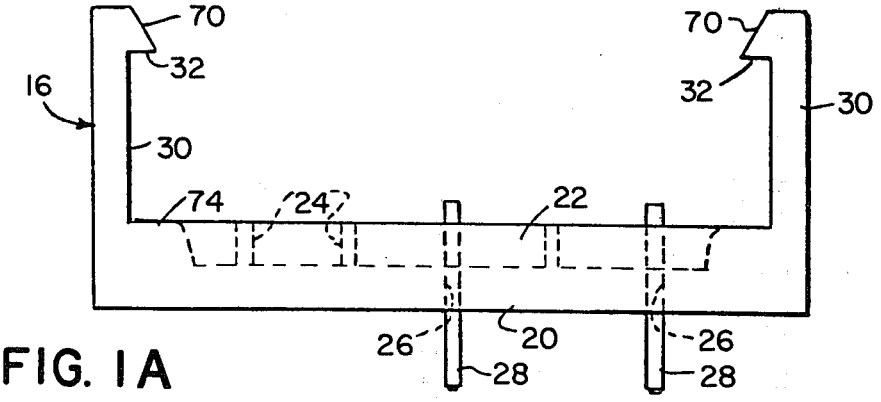
FIGS. 1(A) and 1(B) are side elevation views of the two portions of a connector block in accordance with the present invention with internal elements being shown in phantom.
Figure 1B:
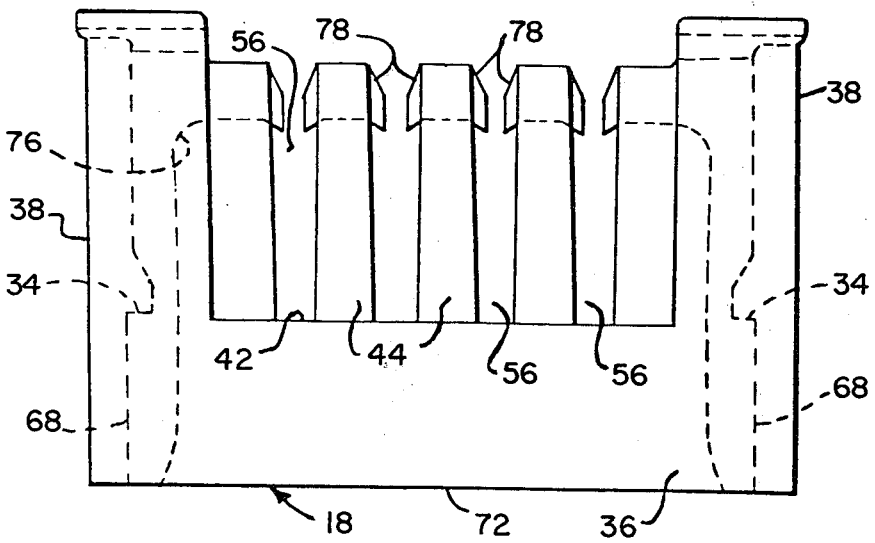

Block 10 is comprised of two basic interlocking parts. These two parts are a retainer 16 and a main body unit 18, both of which are molded plastic elements. For purposes of clarity and understanding, retainer 16 and main body unit 18 are separately shown in FIGS. 1(A) and 1(B) respectively. FIGS. 1(A) and 1(B) thus depict separate non-conductive parts of the assembled unit shown in FIGS. 2–4. Retainer 16 has a base portion 20 with a series of latitudinal (side to side) interrupted slots 22 therein corresponding to the number of rows of conductive connector elements to be housed in the block. Retainer 16 is al provided with a series of upstanding spacer members 24 which are integral with retainer 16 and extend upwardly from the fase of the slots 22. The spacers 24, which constitute interruptions in slots 22, are arranged in a predetermined pattern and are aligned with bridges 44 of main body unit 18. In those areas of the slots 22 in retainer 16 which will be in alignment with a bridge 44 in body unit 18 when the retainer and body unit are assembled, and where a spacer 24 has not been formed, an aperture 26 is provided through the base 20 of retainer 16, the apertures 26 thus communicating with the interrupted slots 22. A wire wrap conductive pin 28 is press fit into each of apertures 26. Pins 28 will typically extend out of slots 22, i.e., the pins will terminate above the "floor" 74 defined in part by the tops of spacers 24.

Wire wraps 28 are comprised of an electrically conductive material, and are preferably of rectangular shape. While FIGS. 1(A) and 2, illustrate only two apertures 26 and wire wrap pins 28 positioned in a slot 22, it is to be noted that any arrangement is possible depending upon the desired end use. As will be discussed below, the portion of each wire wrap pin 28 disposed within a slot 22 is frictionally engaged by and in electrical contact with a connector element.

Retainer 16 also has a plurality of locking arms 30 which extend upwardly from base 20 along each side of the retainer. Locking arms 30 are slightly resilient and springy, so that they can be deflected outwardly and then spring or snap back into place to lock retainer 16 and main body unit 18 together. The upper part of each locking arm 30 has an inwardly projecting locking surface or shoulder 32 which engages a corresponding locking surface or shoulder 34 on main body unit 18.

Figure 4:
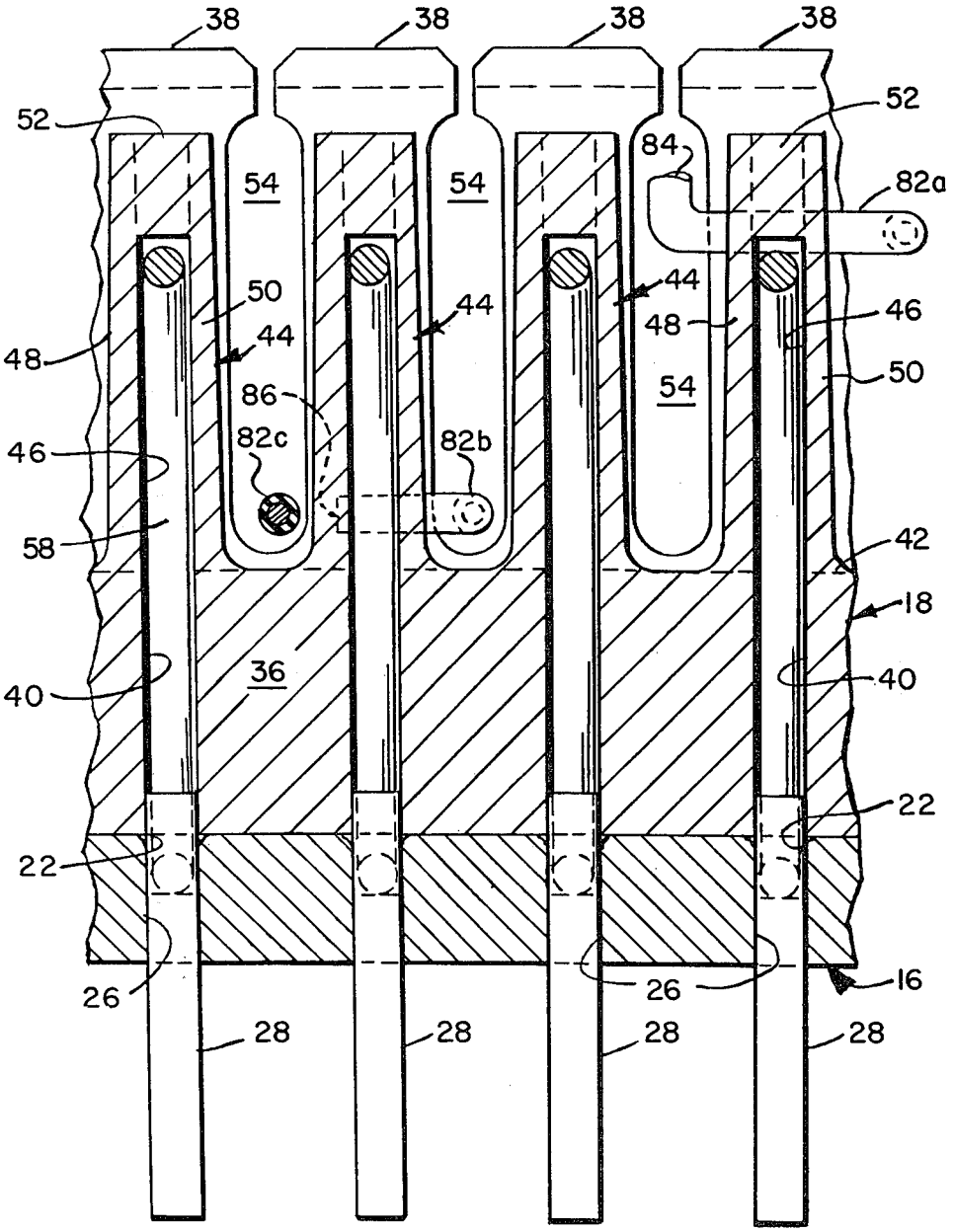
FIG. 4 is a partial sectional detail taken along line 4—4 of FIG. 3, FIG. 4 being a view which is transverse to FIG. 2.

Referring now to FIGS. 1(A), 1(B) and 4, main body unit 18 has a main body portion 36 with two fanning strips, defined by posts 38, running along each side. The fanning strips serve as a means of orderly entry into the block for the insulated conductors of a communications cable or system which are to be electrically connected to solderless connectors in the block. Main body unit 18 includes, in body portion 36, a plurality of longitudinal slots 40 (as seen IN FIG. 4) which correspond to and are in alignment with each of the longitudinal slots 22 in base 20 of retainer 16. Body unit 18 has an internal floor or surface area 42 from which a series of inverted U-shaped bridges 44, which are integrally molded parts of main body unit 18, project. The outermost of bridges 44 are integral with posts 38 of the fanning strips. Each bridge 44 has a passage or opening 46 in alignment with the slots 22 and 40. As will be described in more detail hereinafter, the slots 22 and 40 and the passages 46 serve to house and position rows of wire formed solderless connectors. In the embodiment shown in the drawings, there are six rows of the aligned slots 22 and 40. Each bridge 44 can be considered to be made up of a pair of uprights 48 and 50, joined together by a cross piece 52, which define the passages 46. It will, of course, be understood that all of the bridges 44 are of similar construction, so only illustrative ones are marked in the drawings. As best shown in FIGS. 3 and 4, the bridges are spaced apart to define open rows 54 in which to run wires from the fanning strips. As may be seen from FIG. 3, the bridges 44 are also spaced to define columns 56 through which access is had to connect the conductors of wires to the connector elements housed in the block.

With reference to FIG. 2, a wire formed solderless connector is indicated generally at 58. Connector 58 is formed from any suitable electrically conductive wire stock having sufficient resiliency. The wire stock is bent to form two coplanar opposite facing rows of loops 60 and 62, respectively. The loops of upper row 60 are formed with straight parallel sides 64, while the loops of lower row 62 are formed with inwardly converging sides 66. The radius of the curved portion of lower loops 62 is less than that of the curved portion which connects the straight sides of the upper loops 60. The straight parallel sides 64 of adjacent of the upper loops 60 are in contact and define therebetween individual connectors. In use, an insulated wire conductor, not shown, is inserted between two adjacent sides 64. As the wire is forced downwardly between two adjacent loops in row 60, any insulation is sheared away at the contact point between the upper loop sections. This shearing action is partly a result of the dimensioning of passages 46 which retains the connectors against lateral movement. This shearing action is diminished as the conductor is forced between the sides 64, since these sides 64 are allowed to bow outwardly. Restated, the multiple terminal connectors 58 function as end-supported beams.

The loops in row 62 are spatially separated from each other to allow the positioning of spacers 24 or wire wrap pins 28 between them. This spatial separation is selected to allow the loops to firmly grasp the wire wrap pins 28 and maintain a good electrical connection thereto. The utilization of wire wrap pins 28 in conjunction with wire-formed connectors 58 allows for more possible arrangements of electrical interconnections. The spacers 24 and pins 26 are sized and shaped so as to preclude relative movement between loops 62 after the connecter block has been assembled.

In assembling a block in accordance with the present invention, the wire formed solderless connectors 58, one of such row type connectors being clearly seen in FIG. 2, are loaded into the slots 40 and bridge passages 46 of main body unit 18. Retainer 16 is then placed in position relative to the main body unit, with the slots 22 in alignment with the connectors 58, and the base and main body unit are then moved together to come into locking engagement. As can best be seen in FIGS. 1(A) and 1(B), the innermost extension of shoulder 32 on the locking arms 30 overlaps main body surfaces 68 over which the arms must slide in assembling the unit. Thus, when assembling the unit, the inclined surfaces 70 on arms 30 will be engaged by surfaces 68, whereby the locking arms 30 are cammed and deflected outwardly as retainer 16 and main body unit 18 are moved together. When the retainer and main body unit have been positioned so that the bottom 72 of body portion 36 is adjacent to the floor 74 of retainer body 20, the locking arms snap inwardly with locking shoulder 32 overlapping cooperating shoulder 34 to complete the assembly of the block. In this manner, the wire formed connector strips are locked and retained in place in the block and are ready to receive single or plural, insulated or bare, single conductor or stranded wires to be mounted thereon. During this assembly procedure, the pins 26 and the spacers 24 will be forced between lower loops 62 of the connector element 58.

With particular attention to FIGS. 2 and 4, an important feature of a connector in accordance with the present invention is illustrated in that each row of wire connectors 58 is fully retained against movement or deflection toward any adjacent row, since the lower loops of each wire connector row are fully captured in a slot 22 and the connector rows are also captured in slots 40 and the bridge passages 46 in the bridges 44. Thus, each wire connector row is fully constrained against displacement which would create misalignment and interfere with the insertion of wires. Also, the bridges 44, especially cross pieces 52, shield the wire connectors and prevent short circuiting by outside objects which might fall into or otherwise come into contact with the top of the block, this protection being realized without the need for a separate cover on the block.

The present invention not only retains each row of wire-formed connectors against deflection toward an adjacent row, but also resists lateral deflection of each connector row when a conductor is inserted therebetween. As clearly seen in FIGS. 2 and 4, each wire-formed multiple connector 58 is snuggly captured within slots 40 of main body 18 and passages 46 of U-shaped bridges 44. The upper loops at each end of each connector are retained against outward movement by the upper side walls 76 of the outermost of bridges 44. Each loop of each connector wire is also prevented from overlapping the adjacent loops by the uprights 48 and 50 of bridges 44 and thus the bridges function to stiffen the upper loops of the connectors.

The lateral retention and stiffening of the upper loops or portions of the wire-formed connectors 58 within the blocks 10 is another important feature of a connector in accordance with the present invention. Since the upper loop portions of the wire connectors are prevented from lateral movement when an electric wire is inserted therebetween, wire insertion results in a high compression force which strips away the insulation from the conductor of the wire. This compressive force decreases as the conductor is forced downwardly between a pair of cooperating loops of the connector, since the two straight portions of the wire connector are allowed to bend outwardly as shown in FIG. 1. This prevents cold flow of the conductor as it is inserted into the connector. Thus, to summarize, the loops of the wire-formed connector generate a high force upon initial wire insertion and the high force strips any insulation from the wire. When fully inserted, however, the wire is positioned between straight sections of the connector, i.e., between straight sections of end supported beams which can bend. The application of a force which is initially high and which decreases in the direction of wire insertion is completely contrary to prior art practice.

Another important feature attributable to the above-discussed lateral retention is that the insertion of two or more conductors between a single pair of loops of the connector will not force apart the upper loop portions. This assures that the insulation will be stripped away, even after repeated use. It should thus be apparent to those skilled in the art that even after repeated use of the connectors of the present invention, there will be no outward expansion of the upper loop portions which would diminish their insulation stripping function. Also, the connector blocks of the present invention will reliably receive and retain multiple electrical conductors at each connector location.

Referring now to FIGS. 1(B) and 2, another important feature of the present invention is illustrated in the presence of wings or projections 78 at the top part of each bridge 44. These wings 78 extend between and toward adjacent bridges within a row, so that they narrow the gap between adjacent bridges within each row. The tops of adjacent wings 78 on adjacent bridges 44 are inclined to define a lead in area or ramp to guide an electric wire into position for insertion in the connector block and electrical and mechanical attachment to the wire formed in the block. As can also be seen in FIGS. 1(B) and 2, each wing 78 terminates in a downwardly pointed end surface 80 which serves as a retention mechanism to hold the electrical wire in place in anticipation of connection to the wire formed connector strip. This retention mechanism is effected due to the fact that the insulation covering on a wire conductor is slightly compressed as it passes through the opening defined by the wings 78 between adjacent bridges 44, and the pointed ends 80 frictionally engage and retain the outer insulation of the wire. Thus, an important feature of the invention resides in the fact that a conductor to be inserted in the connector can be placed in the block in anticipation of eventual connection, and will be relatively firmly retained in place until the insertion-connection operation is actually performed. Thus, the winged extensions 78 of the bridges 44 serve both to provide lead ins for the wires and retain the wires in place in anticipation of connection to the connectors in the block. The wires to be connected to the block will, typically, be lead into the block through the open rows 54 between adjacent posts 38 of the fanning strips, and the wires will then be laid into the position discussed immediately above with respect to FIG. 1 in anticipation of eventual connection to the wire-formed connector strip 58.

The actual mechanical and electrical connection of conductor wire to the wire connector 58 will, typically, be effected by means of a wire insertion tool somewhat similar to the general type presently used for inserting wires into "66 Type" connectors of the type shown in U.S. Pat. No. 3,132,913. A tool designed for use with the connector block of the present invention is disclosed in my co-pending application Ser. No. 233,983 filed Feb. 12, 1981 and assigned to the assignee of the present invention. Mechanical and electrical connection of a wire conductor to the connector 58 is effected by forcing the wire downwardly between adjacent loops of wire connector 58. The wire conductor will typically be forced down to floor 42. As this happens, as described above, the insulation is sheared and adjacent straight sections of the loops of the connector are subsequently urged apart, and generate strong spring return forces, so that firm physical and electrical contact is established between the wire core of the electrical conductor and the adjacent loop surfaces of the wire connector 58.

Referring to FIG. 4, a wire 82(*a*) is shown in position in the row on the right in anticipation of eventual connection to a wire formed connector 58. In the position as shown, conductor 82(*a*) has been led in from a fanning strip, positioned along a open row 54 between adjacent rows of bridges 44, and is being retained in position between the pointed ends 80 of wings 78. A loose end 84 of the wire 82(*a*) extends toward the next (i.e., left) row of connectors 58. Still referring to FIG. 4, a conductor 82(*b*) is shown positioned at the bottom of a open row 54 after it has been inserted into the wire formed connector 58 and connected thereto mechanically and electrically. The wire insertion tool which would typically be used to complete the wire connection may have a cutoff blade which will react against floor 42 to sever the loose end of the electrical conductor at 86. As can also be seen in FIG. 4, the end 86 of the wire may be severed at a position where it extends past the wire formed connector 58, the extension contributing to the strength of the mechanical connection, while still being within the confines of the bridge 44 and uprights 48 and 50 so that there is no interference with an adjacent conductor 82(*c*) which runs along the next open row 54 between rows of bridges 44. Thus, each conductor wire may be positioned and severed with the confidence that the cutting blade will not cut into the running wire in the next row.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A block for housing electrically conductive wire-formed connector elements of the type having oppositely facing and interconnected upper and lower rows of loops, the block including:

a retainer section, said retainer section having opposite first and second surfaces;

a plurality of rows of spaced slots in said retainer section first surface;

at least some of said spaced slots of said retainer section being provided with apertures and spacers, said apertures and said spacers each being positioned so as to be equidistant from the centers of an adjacent pair of loops of a connector element, said apertures communicating with said retainer section second surface, each of said spacers being a protrusion which will be positioned between and in contact with two adjacent lower loops of a connector element;

a discrete number of elongated electrically conductive pin means, said pin means being positioned and retained within said apertures of said spaced slots, portions of said pin means extending outwardly beyond both of said first and second surfaces of said retainer section, said portion of said pin means extending from said first surface of said retainer section being positioned between and in electrical contact with two adjacent lower loops of a connector element;

a main body section;

a plurality of rows of spaced slots in said main body section in alignment with corresponding rows of slots in said retainer section;

a plurality of bridge elements on said main body section in bridging alignment with the slots in each row of said main body section, each bridge element defining a passage in alignment with corresponding slots in the main body section and the retainer section;

said corresponding retainer slots, main body slots and bridge passages cooperating to define housings for rows of electrically conductive wire connector elements;

said bridge elements in each row being spaced apart and in alignment with bridge elements in other rows to define spaced columns for connection of electrical conductors to wire connector elements; and means for releasably joining said retainer section and said main body section together.

2. A block as in claim 1 wherein:

said main body section has a floor spaced from said retainer section; and said bridge elements extend from said floor away from said retainer section.

3. A block as in claim 2 wherein:

each of said bridge elements is an inverted U-shaped element integrally molded with the block and having uprights joined together by a cross piece.

4. A block as in claim 1 wherein:

each of said bridge elements is an inverted U-shaped element integrally molded with the block and having uprights joined together by a cross piece.

5. A block as in claim 1 wherein:

bridge elements in each row have projections at the top thereof extending toward adjacent bridge elements in the row.

6. A block as in claim 5 wherein:

said projections on adjacent bridge elements cooperate to define a lead in area for insertion of an electrical conductor.

7. A block as in claim 6 wherein:

said projections on adjacent bridge elements cooperate to define retaining means to retain an electrical conductor therebetween prior to connection to a wire connector.

8. A block as in claim 5 wherein:

said projections on adjacent bridge elements cooperate to define retaining means to retain an electrical conductor therebetween prior to connection to a wire connector.

9. A block as in claim 5 wherein:

adjacent projections on adjacent bridge elements define a space for alignment with conductor receiving portions of a wire connector housed in the block.

10. A block as in claim 1 including:

fanning strips on the sides of said main body section;

said fanning strips defining passages in alignment with spaced rows between rows of said bridges for entry of electrical conductors.

11. A block as in claim 1 wherein:

said releasable joining means includes locking arms extending from said retainer section, and locking surfaces on said main body section for locking engagement with said locking arms.

12. A block as in claim 1 wherein said elongated electrically conductive pin means are planar with first and second ends, said first end being provided with two planar oppositely disposed perpendicular extensions, said extensions being extended out from said first surface of said retainer section, said extensions being partially positioned within said slots of said retainer section.

13. A block as in claim 1 wherein a wire conductor is mechanically and electrically connected to said second end of said pin means.

14. A block as in claim 12 wherein a wire conductor is mechanically and electrically connected to said second end of said pin means.

15. A block as in claim 1 wherein:

each of said slots in said main body section is dimensioned to restrain the electrically conductive wire connector element from lateral movement.

16. A block as in claim 15 wherein said bridge elements are aligned in rows and wherein the passages in the bridge elements at the opposite ends of each row are in the form of U-shaped slots, the wire connector elements engaging the bottoms of said U-shaped slots.

17. A block for housing electrically conductive wire-formed connector elements of the type having oppositely facing and interconnected rows of upper and lower loops, the block including:

a retainer, said retainer having oppositely disposed first and second surfaces, said retainer first surface being provided with a plurality of parallel discontinuous slots;

a main body, said body being provided with a plurality of parallel slots extending therethrough;

means releasably connecting said retainer and said main body together with said retainer second surface in contact with a first surface of said body and with said slots in registration;

projection means extending from said main body and cooperating with the aligned slots in said main body and said retainer first surface to define housings for rows of connector elements;

at least some of said spaced slots of said retainer being provided with apertures and spacers, said apertures and said spacers each being positioned so as to be equidistant from the centers of a pair of adjacent loops of the connector element, said apertures communicating with said retainer section second surface, each of said spacers being a protrusion which will be positioned between and in contact with two adjacent lower loops of a connector element; and a discrete number of elongated electrically conductive pin means, said pin means being positioned and retained within said apertures of said spaced slots, portions of said pin means extending outwardly beyond both of said first and second surfaces of said retainer section, said portion of said pin means extending from said first surface of said retainer section being positioned between and in electrical contact with two adjacent lower loops of a connector element;

said projection means being aligned to define spaced columns and rows of connector locations in said block.

18. A block as in claim 17 wherein:

said projecting means includes bridge elements with passages therein in alignment with aligned slots in said main body section and said retainer section.

19. A block as in claim 17 wherein:

said main body section has a floor spaced from said retainer section; and said bridge elements extend from said floor away from said retainer section.

20. A block as in claim 19 wherein:

each of said bridge elements is an inverted U-shaped element having uprights joined together by a cross piece.

21. A block as in claim 18 wherein:

each of said bridge elements is an inverted U-shaped element having uprights joined together by a cross piece.

22. A block as in claim 17 wherein:

bridge elements in each row have projections at the top thereof extending toward adjacent bridge elements in the row.

23. A block as in claim 22 wherein:

said projections on adjacent bridge elements cooperate to define a lead in area for insertion of an electrical conductor.

24. A block as in claim 23 wherein:

said projections on adjacent bridge elements cooperate to define retaining means to retain an electrical conductor therebetween prior to connection to a wire connector.

25. A block as in claim 22 wherein:

said projections on adjacent bridge elements cooperate to define retaining means to retain an electrical conductor therebetween prior to connection to a wire connector.

26. A block as in claim 22 wherein:

adjacent projections on adjacent bridge elements define a space for alignment with conductor receiving portions of a wire connector housed in the block.

27. A block as in claim 18 including:

fanning strips on the sides of said main body section;

said fanning strips defining passages in alignment with spaced rows between rows of said bridges for entry of electrical conductors.

28. A block as in claim 18 wherein:

said releasable joining means includes locking arms extending from said retainer section, and locking surfaces on said main body section for locking engagement with said locking arms.

29. A block as in claim 17 wherein:

each of said slots in said main body section is dimensioned to restrain the electrically conductive wire connector element from lateral movement.

30. A block as in claim 29 wherein said bridge elements are aligned in rows and wherein the passages in the bridge elements at the opposite ends of each row are in the form of U-shaped slots, the wire connector elements engaging the bottoms of said U-shaped slots.

31. A block as in claim 17 wherein said elongated electrically conductive pin means are planar with first and second ends, said first end being provided with two planar oppositely disposed perpendicular extensions, said extensions being extended out from said first surface of said retainer section, said extensions being partially positioned within said slots of said retainer section.

32. A block as in claim 17 wherein a wire conductor is mechanically and electrically connected to said second end of said pin means.

33. A block as in claim 31 wherein a wire conductor is mechanically and electrically connected to said second end of said pin means.

34. A multiple terminal solderless connector comprising:

a discrete number of interconnected loops, said loops being formed from a continuous piece of conductive resilient material, said loops being arranged in a coplanar relationship between two end loops, said loops each having two straight parallel side portions interconnected by a curved portion, the straight side portions of adjacent of said loops being in abutting relationship, at least all of those loops intermediate the end loops being provided with a pair of extensions of said straight side portions, said extensions being nonparallel and converging toward one another, said extensions of said abutting side portions of said adjacent loops being interconnected by an arcuate section, said interconnecting arcuate sections of said adjacent loops being spatially separated, said arcuate sections each having a smaller radius than that of the curved portion of the loops it interconnects.

35. The connector of claim 34 further including:

a discrete number of elongated electrically conductive pin means, said pin means being partially retained between and in electrical connection with said spatially separated interconnecting arcuate sections of said adjacent loops, said pin means projecting from said connector.

36. The connector of claim 35 wherein said pin means also lies within said plane.

37. A block as in claim 36 wherein said elongated electrically conductive pin means are planar with first and second ends, said first end being provided with two planar oppositely disposed perpendicular extensions, said extensions being extended out from said first surface of said retainer section, said extensions being partially positioned within said slots of said retainer section.

38. A block as in claim 37 wherein a wire conductor is mechanically and electrically connected to said second end of said pin means.

* * * * *